US007178800B2

(12) United States Patent
Stauber

(10) Patent No.: US 7,178,800 B2
(45) Date of Patent: Feb. 20, 2007

(54) DEVICE FOR ESTABLISHING AN IMBRICATED STREAM OF FLAT ARTICLES

(75) Inventor: H. Ulrich Stauber, Grüt (CH)

(73) Assignee: Ferag AG, Hinwil (CH)

( * ) Notice: Subject to any disclaimer, the term of this patent is extended or adjusted under 35 U.S.C. 154(b) by 352 days.

(21) Appl. No.: 10/815,088

(22) Filed: Mar. 31, 2004

(65) Prior Publication Data

US 2004/0195759 A1 Oct. 7, 2004

(30) Foreign Application Priority Data

Apr. 2, 2003 (CH) ..... 585/03

(51) Int. Cl.
*B65H 29/68* (2006.01)

(52) U.S. Cl. ..... 271/189; 271/182; 271/202

(58) Field of Classification Search ..... 271/256, 271/258.05, 264, 286, 182, 183, 181, 151, 271/202, 243, 237, 150; 198/419.9, 419, 198/423

See application file for complete search history.

(56) References Cited

U.S. PATENT DOCUMENTS 3,547,024 A 12/1970 Lopez
4,666,140 A * 5/1987 Godlewski ..... 271/35
4,666,141 A * 5/1987 Labombarde ..... 271/35
4,667,950 A 5/1987 Linder et al.

(Continued)

FOREIGN PATENT DOCUMENTS

EP 0 075 121 B1 5/1985

(Continued)

OTHER PUBLICATIONS

WO 96/38361, Device for Separating Stacked Flat Objects, Publication Date: Dec. 5, 1996.

*Primary Examiner*—Patrick Mackey
*Assistant Examiner*—Kaitlin Joerger
(74) *Attorney, Agent, or Firm*—Rankin, Hill, Porter & Clark LLP

(57) ABSTRACT

A device comprising a dancing roller (1) and a stopping means (2) is used for establishing an imbricated stream of flat articles (4), in particular of printed products such as newspapers, magazines or brochures, from a supplied imbricated stream or stream of imbricated stacks or from a stack of the articles (4). The dancing roller (1) and the stopping means (2) co-operate with a conveying surface (3). The conveying surface (3) acts on the imbricated stream from the side of the trailing article edges. The dancing roller (1) and the stopping means (2) act on the side of the leading article edges. The dancing roller (1) is arranged downstream of the stopping means (2) and controls the stopping means (2), by being mechanically coupled to it, in such a manner, that the width of a passage gap between the stopping means (2) and the conveying surface (3) is enlarged such, that an article (4) held up by the stopping means is able to pass through the passage gap, when the dancing roller senses the leading edge of the preceding article. The device is suitable for being employed in particular in the further processing of printed products, e.g., for establishing imbricated streams of individual printed products from streams of imbricated stacks. The essential advantages of the device reside in its simplicity and in its many and diverse possibilities of being utilised.

17 Claims, 4 Drawing Sheets

U.S. PATENT DOCUMENTS 4,713,831 A * 12/1987 Morisod ..... 377/8
4,746,004 A * 5/1988 Hess et al. ..... 198/418.9
4,911,421 A * 3/1990 Hannon ..... 271/161
5,249,790 A * 10/1993 Brame et al. ..... 271/182
5,288,067 A * 2/1994 Stock ..... 271/276
5,934,668 A * 8/1999 Debarber et al. ..... 271/245

FOREIGN PATENT DOCUMENTS

EP 0 254 851 A1 6/1987

* cited by examiner

DEVICE FOR ESTABLISHING AN IMBRICATED STREAM OF FLAT ARTICLES

BACKGROUND OF THE INVENTION

1. Field of the Invention

The invention is situated in the field of good piece conveyance and is related to a device which serves for establishing an imbricated stream of flat articles, in particular of printed products such as, e.g., newspapers magazines or brochures.

In the printing industry, intermediate or partial products or also virtually finished products are subjected to various further processing steps. In certain devices intended for such further processing steps, for example, in cutting devices, it is advantageous to process such products lying on top of one another in groups. Imbricated streams accruing from such further processing steps are then streams of imbricated stacks, in which streams every scale is a stacked product group of, for example, two products. If, for example, the products of such a stream of imbricated stacks are to be counted, addressed or stacked and packaged independent of the group size, the stream of imbricated stacks has to be transformed into a stream of imbricated single products, i.e., into an imbricated stream, in which every scale consists of one product only. For other processing steps it may also be necessary to transform a simple imbricated stream into a stream of imbricated stacks or to make the spacings in a simple imbricated stream more uniform.

2. Description of Related Art

A device for extending printed product pairs being supplied in an imbricated stream (stream of imbricated stacks) is known from EP 0 075 121 B1. The stream of product pairs in which the pairs are transported on a conveyor belt at a first speed and in a formation in which in the manner of roof tiles the leading edge of each pair is lying on top of the preceding pair, is transformed into a stream of imbricated individual products being transported, for example, at double the first speed (second speed). For this purpose, the stream of imbricated stacks is accelerated to the second speed and is conveyed past a retarding device, which comprises a belt moving at the first speed and being arranged to hold back the upper product of each product pair, while the lower product of the pair is conveyed onwards at the second speed. The upper product is released by the retarding device as soon as a following product pair reaches it.

The spacing between the scales (single products) of such an established imbricated stream is dependent on the ratio of first and second speed and on the scale spacing in the stream of imbricated stacks being supplied to the transformation. If the scale spacing in the supplied stream of product pairs is irregular, then this is also the case in the imbricated stream being established by the transformation.

A device for making an imbricated stream more regular is known from EP 0 254 851 B1. According to this publication, a stream of imbricated products is transported into a stretch constituting a kink in the transport path and not being equipped with active conveying means. Along this stretch the products are stopped by a stop located immediately upstream of the kink. Driving pins arranged on driving wheels deviate the leading zone of every stopped product at a predefined cadence out of the action range of the stop, press it against a belt conveyor aligned in the new conveying direction and guide it into a clamping gap between this belt conveyor and a transport roller engaging the upper side of the product such transporting the product onwards.

The regularizing effect of the device in accordance with EP-254851 is limited; substantial irregularities cannot be equalized. If after the release of a product by the stop, there isn't another product lined up at the stop within one cycle, there will be too large of a distance between the late scale and the preceding one. If several products accumulate at the stop they will usually be conveyed onwards together, because they are driven forward from above by the driving pins and from below by the belt conveyor. Narrowing the gap formed by the stop is supposed to prevent simultaneous release of two products. However, this only works for mechanically robust products. Separating single products from product pairs or from a product stack is possible only with difficulty or not at all.

The operating principle of the device according to EP254851 calls for both actively driven driving pins and transport rollers as well as for a kink in the conveying direction. Therefore it requires a relatively complicated mechanical construction.

BRIEF SUMMARY OF THE INVENTION

The object of the present invention is to create a device of the kind mentioned above, with which device it is to be possible in a very simple manner to create an imbricated stream of individual flat articles from a stream of imbricated article pairs or generally from a stream of imbricated article stacks (stream of imbricated stacks) or from a stack of articles. In the same manner, the device is to be suitable for creating a further stream of imbricated stacks from a first stream of stacks or from a stack, wherein in the created stream all stacks have predefined, equal heights or comprise the same number of articles respectively. The device according to the invention makes very few demands on the regularity of the article stream supplied to it, i.e. it is capable of processing, without any problems, larger gaps occurring in the supplied stream, individual articles being conveyed within such gaps and larger stacks of articles.

In accordance with the invention, the flat articles are conveyed in a preferentially straight conveying direction, lying loosely on a conveying surface with their leading edges arranged on top of the stream. For establishing the imbricated stream, use is made of a dancing roller and a stopping means, which both act on the upper side of the imbricated stream. The dancing roller is positioned downstream of the stopping means and senses the established imbricated stream. The stopping means together with the conveying surface forms a passage gap, the width of which (distance between the stopping means and the conveying surface) is controlled by the dancing roller in that the dancing roller and the stopping means are coupled together, preferably mechanically, e.g., by being rigidly connected to each other. The width of the passage gap therefore varies with the thickness profile of the established imbricated stream and lets an article, which is stopped behind the stopping means, pass as soon as the dancing roller is lifted by the leading edge of the preceding article.

Therein, it is of no significance, whether the preceding article is a scale within a continuous imbricated stream or forms, together with other articles, the beginning of an imbricated stream (for example, following a gap in the supplied stream), and it is of no significance, whether the sensed, leading edge is the edge of an individual article or of a stack of articles (e.g., of a pair of articles). Within broad limits it is also of no significance how many articles are stopped behind the stopping means. The passage gap allows an article or a stack of articles to pass, when the thickness of the article or of the stack of articles is no greater than the thickness of the leading edge of the preceding article or stack.

The effects of the invention are achieved with the most simple mechanical means. For this purpose, for example, solely a kinematically simple, mechanical coupling between the dancing roller and the stopping means is required. No additional active driving means are necessary, no control systems, sensors or actuators. The conveying surface does not require a change of direction (kink) nor an intermediate stretch without active conveyance.

In a preferred embodiment of the invention, the conveying surface comprises a conveyor belt with openings, which, upstream of the stopping means, co-operates with a suction device in such a manner that an article to be conveyed through the passage gap by the conveyor belt is sucked against the conveyor belt. The suction device is, relative to the conveying direction, arranged and/or if so required controlled in such a manner that the suction effect on an article lying against the stopping means only becomes relevant when the leading edge of the preceding article has reached the dancing roller and as a result of this the stopping means is lifted to allow the passage of the article lying against the stopping means. As the suction effect acts on the trailing zone of the article to be moved through the passage gap, this article is pushed forward from underneath further articles lying on top of it without problems. This effect furthers effectiveness and reliability of the device in accordance with the invention. Preferably, the suction device operates without being controlled by active control means.

As still remains to be demonstrated, the device, the essential components of which are the dancing roller and the stopping means being controlled by the dancing roller and co-operating with a conveying surface, is very easily adjustable for different scale spacings in the imbricated stream to be produced and for different article formats and article thicknesses.

The scale spacing in the imbricated stream to be established is solely dependent on the distance (in the direction of conveyance) between the dancing roller and the stopping means. Because the release of an article is triggered by the preceding article, the scale spacing in the established imbricated stream is essentially independent of spacings, spacing accuracies and speed of the articles in the supplied stream, as long as at least one article is conveyed to the stopping means, before the preceding article reaches the dancing roller. The scale spacing in the imbricated stream to be established may have to be adapted to the conveying force (friction between the conveying surface and the articles) and to the friction between the articles themselves.

The invention also allows buffering or stacking of articles upstream of the stopping means. This is advantageous in particular, when the supplied imbricated stream comprises large spacings or even gaps. If ahead of a gap in the supplied stream there is a sufficient number of articles lined up at the stopping means, the gap has no effect on the established imbricated stream. If the gap is larger, there will also be a gap in the established imbricated stream. However, it will be possible without problem and without further measures to recommence establishing the imbricated stream from the articles being supplied after the gap.

Further preferred embodiments of the method and of the device in accordance with the invention are defined in the dependent claims.

BRIEF DESCRIPTION OF THE DRAWINGS

In the following, the invention is explained in more detail on the basis of preferred embodiments, which are illustrated in the attached Figures, wherein.

In all Figs. same components are identified with the same reference numbers.

DETAILED DESCRIPTION OF THE INVENTION

Figure 1:
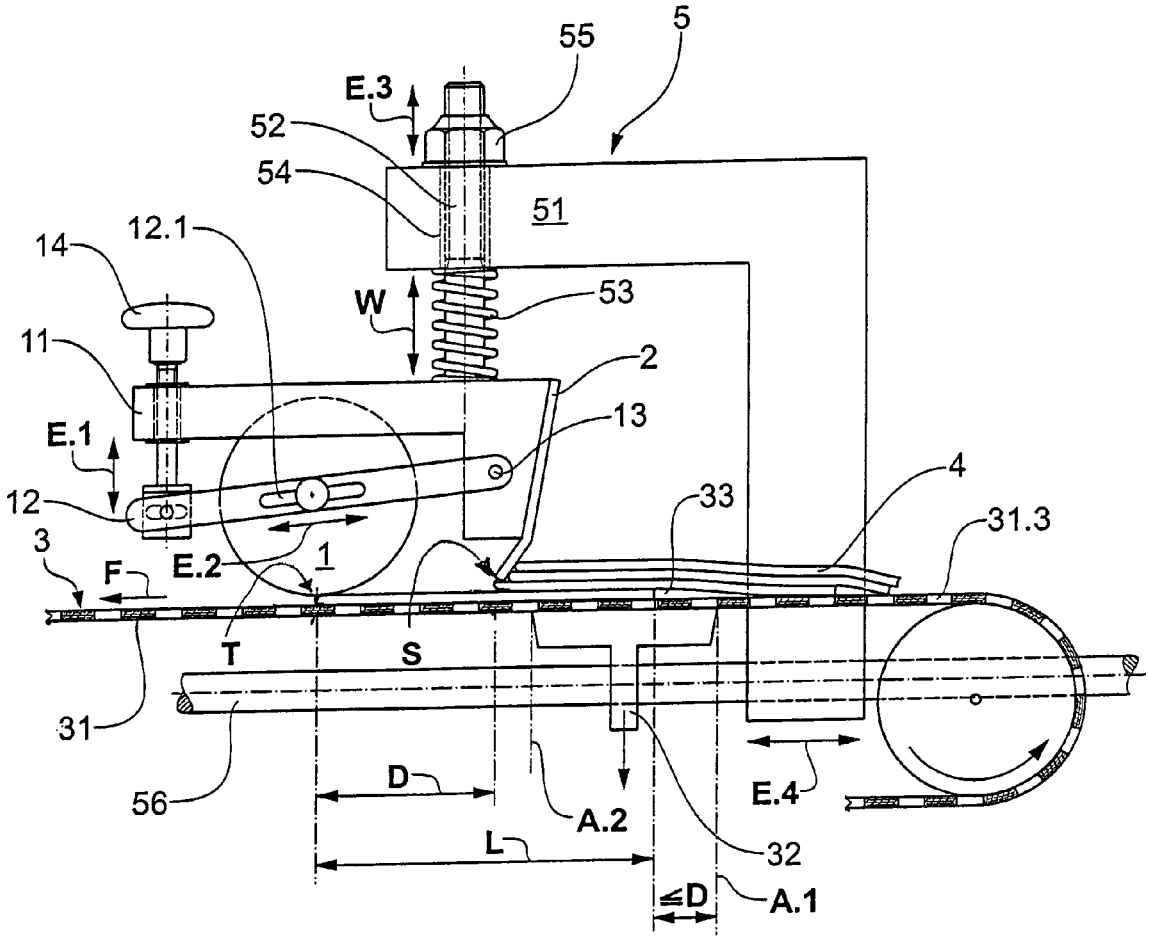
FIG. 1 is a schematic side view of a first, exemplary embodiment of the device according to the invention.

FIG. 1 is a schematic representation of an exemplary embodiment of the device according to the invention. As already mentioned further above, the device comprises as its most important elements a dancing roller 1 and a stopping means 2. These are arranged on a frame 11. Relative to a conveying surface 3 (e.g., a conveyor belt) driven in a conveying direction F, the frame 11 is positioned in such a manner, that the dancing roller 1 and the stopping means 2 face towards the conveying surface 3 and that the dancing roller 1 is arranged downstream of the stopping means 2. Dancing roller 1 and stopping means 2 are rigidly coupled together by the frame 11, but, if so required, may be adjustable relative to each other. The dancing roller 1 is freely rotating.

The frame 11 is supported by support 5 and is movable to a limited extent and essentially vertically towards the conveying surface 3 and away from it (double arrow W). The support 5, for example, comprises a guide block 51 with, for example, two (one visible) through bores 54. Pins 52 fixed on the frame 11 extend through the bores (parallel guiding) and are held in place by nuts 55. Slightly pre-tensioned coil springs 53 are arranged around the pins 52, between the guiding block 51 and the frame 11. They drive the frame 11 away from the support 5 towards the conveying surface 3, into a lowest position predetermined by the position of the nuts on the pins.

While the dancing roller 1 rolls on the articles 4 being transported on the conveying surface 3, it is pressed lightly against the articles 4 by the coil springs 53 and is displaced vertically to the conveying surface 3 by the articles, wherein the displacement movement (double arrow W) of the dancing roller is dampened by the coil springs 53. The stopping means 2 follows the displacement of the dancing roller 1, thereby keeping the width of the passage gap between the conveying surface 3 and the stopping means 2 matched to the thickness of the imbricated stream being conveyed underneath the dancing roller 1, and, by the sensing of every leading edge, opening the passage gap in a step-like manner for releasing succeeding articles. Therefore, the scale spacing in the imbricated stream established downstream of dancing roller 1 and stopping means 2 corresponds to the distance D (in the conveying direction) between the sensing point T of the dancing roller 1 and the blocking point S of the stopping means 2.

The conveying surface 3 is designed, for example, as a conveyor belt 31, which is preferably equipped with openings 31.3 rendering it air permeable. In addition, the device comprises a suction device 32 being designed for locally reducing the pressure on the lower side of the conveyor belt 31. The reduced pressure sucks an article 4 lying in the corresponding place on the conveyor belt 31 against the conveyor belt 31, locally increasing the friction between the article and the conveyor belt 31, i.e. the conveying force acting on the article.

The suction device 32 or a chamber of reduced pressure belonging to the suction device and being arranged adjacent to the conveyor belt 31 respectively, is positioned relative to the conveying direction F in such a manner that its effect begins at a point A.1 situated upstream of the dancing roller 1 and the stopping means 2, wherein point A.1 is distanced from the sensing point T by at least the format length L of the processed articles (extension of the articles in conveying direction F) and from the blocking point S by at the most this format length L (L+D from the sensing point T). The suction effect ends at a point A.2 downstream of A.1, wherein the distance (in conveying direction F) between A.1 and A.2 is advantageously at least as great as the distance D. A suction device as described has the effect that the conveying force acting on a lowest article being lined up behind the stopping means 2 is only then significantly increased when the preceding article has reached the dancing roller 1 and has actuated it. Because there is usually an empty space 33 between the trailing portions of the articles and the conveyor belt 31, the suction effect on a succeeding article remains correspondingly smaller.

The device in accordance with the invention is advantageously adjustable as indicated in FIG. 1 with double arrows E.1, E.2, E.3 and E.4 in order to be able to process different articles 4. The optimum adjustments have to be determined experimentally for each type of article to be processed. Suitable adjustments are dependent in particular on the scale spacing and on the number of articles per scale in the imbricated stream to be established, on the format and thickness of the articles to be processed and on the compressibility of the articles in the direction of their thickness.

The distance between the sensing point T of the dancing roller 1 and the conveying surface 3 is adjustable relative to the distance between the blocking point S of the stopping means 2 and the conveying surface 3 (double arrow E.1). This distance difference (height offset H.2, refer to FIG. 3) is adjusted to approximately the thickness of the scales (thickness of an article to be processed or if so applicable of a group of articles) of the imbricated stream to be established. The adjustability E.1 is implemented, for example, by supporting the dancing roller 1 by a supporting arm 12, wherein one end of the supporting arm 12 is connected to frame 11 in a pivoting manner perpendicular to the conveying direction F and around an axis 13 oriented parallel to the conveying surface 3. In addition, the pivoting position of the supporting arm 12 and with it the position of the dancing roller 1 relative to the frame 11 or to the stopping means 2 respectively is adjustable with a setting screw 14 being pivotally connected with the other end of the supporting arm 12.

As already mentioned further above, the distance D between the sensing point T and the blocking point S corresponds to the scale spacing in the established imbricated stream. This scale spacing is therefore adjustable by adjusting (double arrow E.2) the distance (in conveying direction F) between the dancing roller 1 and the stopping means 2. Such adjustment is, for example, implemented by arranging the shaft of the dancing roller 1 displaceably in a slot-shaped opening 12.1 of the supporting arm 12 and by supplying suitable fixing means for fixing it a required position.

The length of the pins 52 between the frame 11 and the upper edge of the bores 54, or the position of the nuts 55 on the pins respectively determines the minimum distance between the sensing point T, or the blocking point S respectively and the conveying surface. This minimum distance is adjustable by turning the nuts 55 (double arrow E.3). Advantageously, the minimum distance (H.1, refer to FIG. 3) of the dancing roller 1 from the conveying surface 3 is adjusted to be greater than zero and smaller than the thickness of the leading edges of the scales (articles or article stacks) of an imbricated stream to be established. By this adjustment the dancing roller 1 is prevented from rolling on the conveying surface 3, when no articles are being transported.

For adapting the device to different formats of articles to be processed, the dancing roller 1 and the stopping means 2 are displaceable in conveying direction F (double arrow E.4) in such a manner, that the distance between the dancing roller 1 and the effective range of the suction device 32 is adapted to the format length L. For this purpose, the support 5, for example, is arranged to be displaceable along rails 56 oriented parallel to the conveying direction F and to be locked in a required position.

Figure 2:
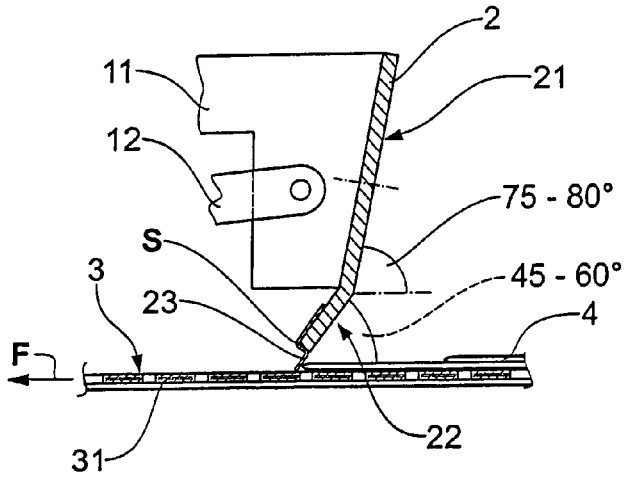
FIG. 2 is a schematic side view of a preferred embodiment of the stopping means of the device in accordance with the invention.

FIG. 2 shows in a larger scale than FIG. 1 the stopping means 2, which preferably comprises on its upstream side two essentially plane surface sections 21 and 22 being oriented transverse to the conveying direction F. The first section 21 further away from the conveying surface 3 forms together with the conveying surface 3 an angle being open towards the upstream side and having a size of approx. 75 to 80 degrees. The second section 22 being situated closer to the conveying surface forms an angle of approx. 45 to 60 degrees. The stopping means 2, for example, is a simple or reinforced piece of sheet metal. However, it may also be a block comprising the above mentioned surface sections. As depicted in FIG. 2, the stopping means 2 may further comprise a flexible braking tongue 23, which extends from the blocking point S towards the conveying surface 3 and has a braking effect on the articles 4 to be processed. The braking tongue 23, for example consists of a plastic material. The braking tongue 23 proves to be advantageous in particular for processing thin articles.

Figure 3:
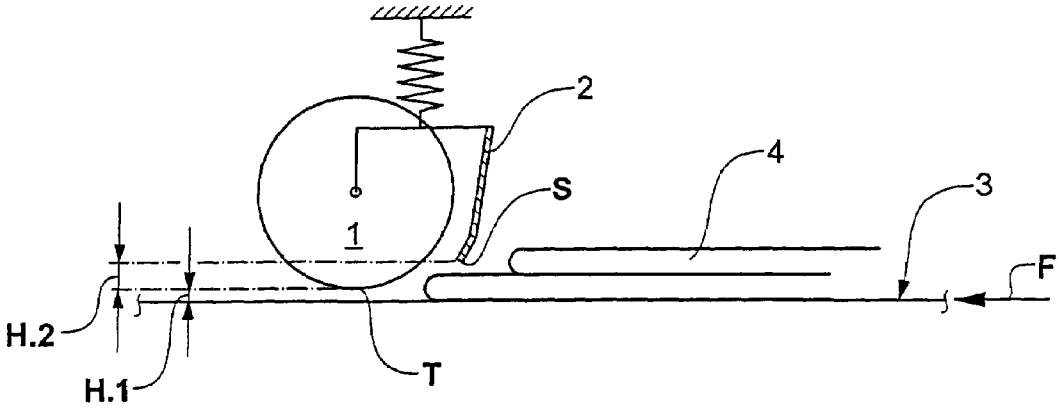
FIG. 3 is a schematic side view of a stage of the method according to the invention during the establishment of the beginning of an imbricated stream.
Figure 4:
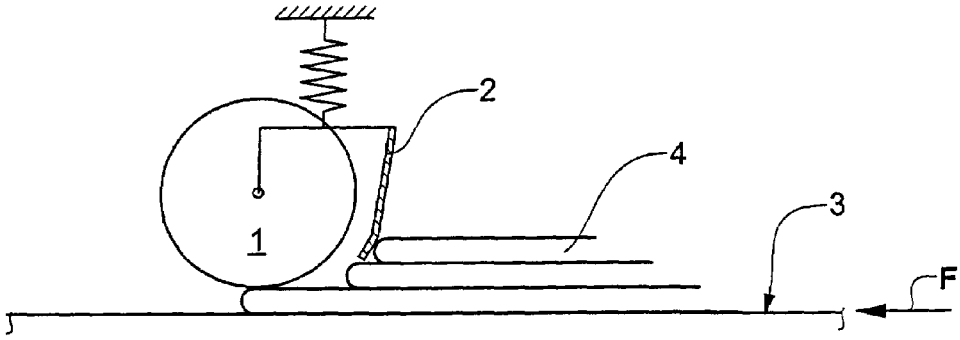
FIG. 4 is a schematic side view of a subsequent state of the method according to the invention during the establishment of the beginning of an imbricated stream.
Figure 5:
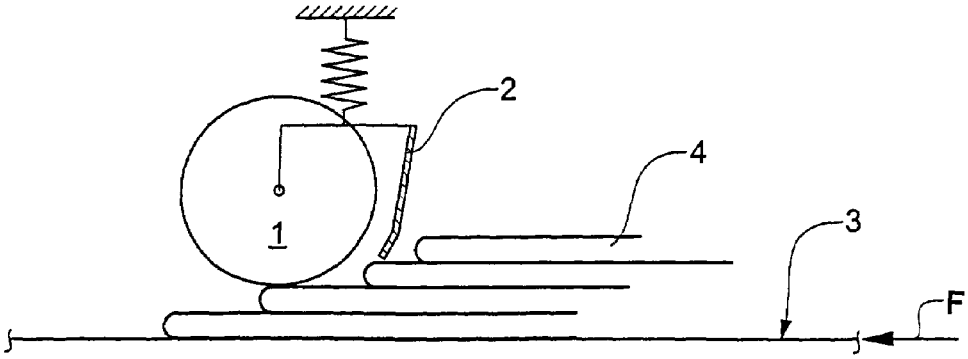
FIG. 5 is a schematic side view of yet a subsequent state of the method according to the invention during the establishment of the beginning of an imbricated stream.

FIGS. 3 to 5 depict successive phases during the beginning of the establishment of an imbricated stream using the device in accordance with the invention (e.g. after a gap in the supply stream or on start-up). Of the device only the dancing roller 1 and the stopping means 2 (the two being rigidly coupled together) are shown. Further shown is the conveying surface 3 which co-operates with the device.

FIG. 3 illustrates a rest position of the device, in which the distance between the sensing point T and the conveying surface 3 is the minimum distance H.1 and the distance of the blocking point S from the conveying surface 3 is the minimum distance H. 1 plus the height offset H.2. This means that a first article is able to be transported through the passage gap.

FIG. 4 represents the device immediately after the dancing roller 1 has sensed the leading edge of a first article. By this, the dancing roller 1 and with it the stopping means 2 are raised by the thickness of the leading edge of this article and thus a further article 4 is able to be transported through the passage gap. FIG. 5 in analogy illustrates the release of a third article 4 by the sensing of the leading edge of the second article.

Figure 6:
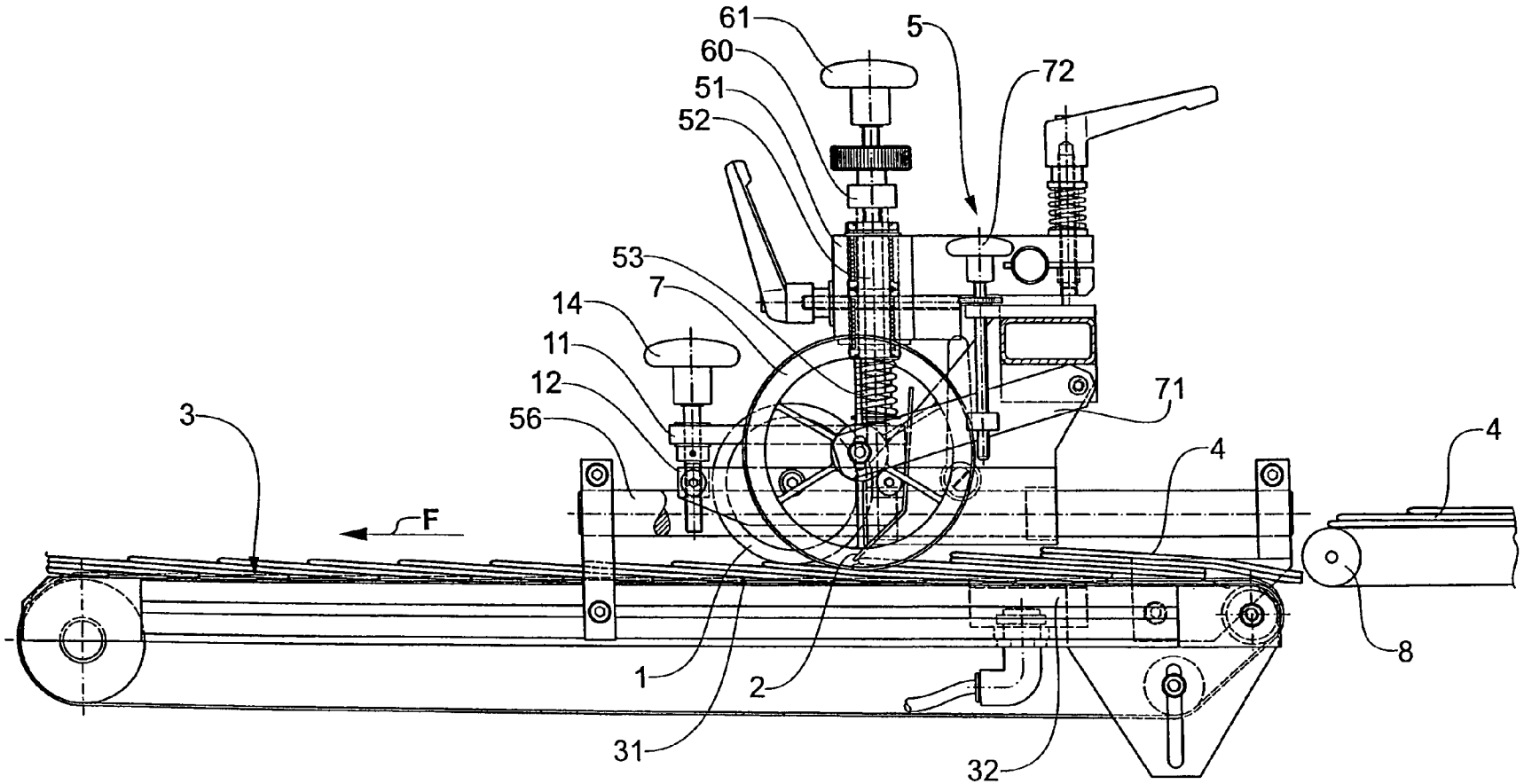
FIG. 6 is a side view of a further preferred embodiment of the device in accordance with the invention.
Figure 7:
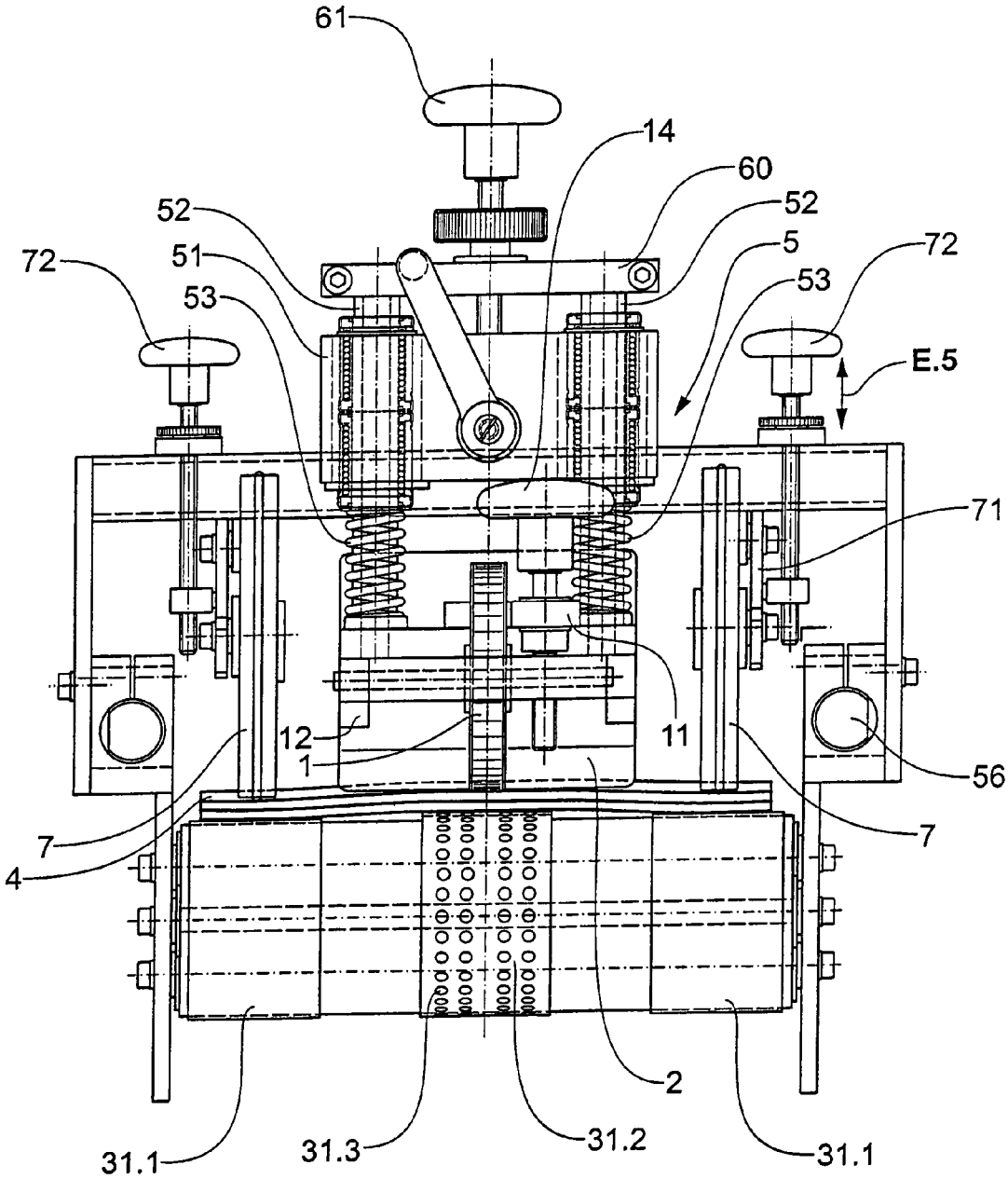
FIG. 7 is a front view of the further preferred embodiment of the device shown in FIG. 6 in accordance with the invention.

FIGS. 6 and 7 show a further, exemplary embodiment of the device according to the invention in more detail than FIG. 1 (FIG. 6: viewed perpendicular to the conveying direction; FIG. 7: viewed parallel to and opposing the conveying direction). The shown device comprises partly the same elements as the device of FIG. 1. These elements are not further described.

In addition, the device according to FIGS. 6 and 7 comprises a pair of bending rollers 7 being arranged on both sides of the frame 11, of the dancing roller 1 and of the stopping means 2. The bending rollers 7 serve for bending articles 4 around a bending axis oriented essentially parallel to the conveying direction F in order to increase their stiffness in conveying direction F. Such increased stiffness prevents buckling, banking up or crumpling of the articles in conveying direction F. By this measure, problems on banking articles behind the stopping means 2 and on pushing them through the passage gap are greatly reduced. Cooperating with the bending rollers 7, if so required, are lateral sections of the conveying surface being essentially bent around a bending axis oriented parallel to the conveying direction F or a correspondingly stepped conveying surface. This is implemented, for example, by two lateral conveyor belts 31.1 and a central conveyor belt 31.2, wherein the three conveyor belts run parallel and the two lateral conveyor belts are arranged somewhat lower than the central conveyor belt and wherein the central conveyor belt 31.2 comprises the openings 31.3.

The bending rollers 7 are located at a distance from the lateral parts of the conveying surface. They determine the minimum bending of the articles, the lateral parts of the conveying surface determine the maximum bending. The point of action of the bending rollers 7 is situated (relative to the conveying direction F) in the region of the stopping means 2.

The bending rollers 7 are supported rotatably in swivelling levers 71, which for their part are supported in a manner allowing of swivelling on the support 5. A lowest swivelling position of the swivelling levers 71 is adjustable with adjusting screws 72 (double arrow E.5) and the swivelling levers are capable of being swivelled upwards from this lowest position at least to a limited extent. For processing products with differing widths it may be advantageous to arrange the bending rollers 7 to be displaceable transverse to the conveying direction F.

In contrast to the device of FIG. 1, in the device of FIGS. 6 and 7, the adjustability (E.3) of the minimum height, is implemented with a transverse beam 60, which connects the upper ends of the two pins 52 and the distance of which from the support 5 is adjusted with an adjusting screw 61.

As already implied further above, the articles 4 may be supplied form a stack behind the stopping means 2, which, if so required, is able to equalize gaps occurring in the supply stream in the manner of a buffer. In order to prevent problems caused by the fact that articles following such gaps need to be positioned on top of articles still present behind the stopping means 2, it is advantageous to arrange the beginning of the conveying surface 3 as close as possible behind the stopping means 2 and to provide a supply belt 8 for supplying the articles, the supply belt being arranged above the conveying surface 3.

In principle it is possible also to supply the device manually with articles, i.e. to manually place relatively high stacks behind the stopping device, from which stack the device produces an imbricated stream.

With the device according to the invention it is possible to process an imbricated stream, an interrupted imbricated stream, an stream of imbricated stacks or individual articles or stacks to form a more or less regular imbricated stream or a stream of imbricated stacks.

In the embodiments of the device in accordance with the invention represented and described above, the conveying surface 3 is essentially horizontal and the articles lie on the conveying surface essentially loosely. However, the device according to the invention may also be operated without any significant limitations when the conveying surface is inclined. In particular, the conveying surface may be vertical perpendicular to the conveying direction, the articles being pressed against it with suitable means. The direction of conveyance is preferably essentially horizontal, but it may also be inclined. For the mentioned embodiments, which differ from the illustrated embodiments by their spatial arrangement, terms such as "horizontal", "vertical", "top", "bottom", etc., utilised in the text are to be correspondingly adapted.

The invention claimed is:

1. A device for establishing an imbricated stream of flat articles (4), in particular of printed products such as newspapers, magazines or brochures, from a supplied imbricated stream, or from a stream of imbricated stacks, or from a stack of the articles (4), the device comprising:

a conveying surface (3) suitable for driving the articles (4) in a conveying direction (F), a stopping means (2) facing towards the conveying surface (3) and defining together with the conveying surface (3) a passage gap for the articles (4), a dancing roller (1) being arranged freely rotating downstream of the stopping means (2) and being biased towards the conveying surface (3), wherein the dancing roller (1) and the stopping means (2) are coupled to be movable together towards and away from the conveying surface (3) such that a width of the passage gap between the stopping means (2) and the conveying surface (3) is controlled by a displacement of the dancing roller (1) caused by the imbricated stream being conveyed, by the conveying surface, beneath the dancing roller (1) and contacting the dancing roller (1), wherein a change in the width of the passage gap is equal to the displacement of the dancing roller (1).

2. The device according to claim 1, wherein the dancing roller (1) and the stopping means (2) are spring mounted on a support (5) in a manner to be movable in a limited manner.

3. The device according to claim 2, wherein the dancing roller (1) and the stopping means (2) are arranged on a frame (11), the frame being movable relative to the support (5), and wherein the dancing roller and the stopping means are rigidly coupled by the frame (11) at least during operation of the device.

4. The device according to claim 3, wherein a height offset (H.2) between the dancing roller (1) and the stopping means (2) is adjustable.

5. The device according to claim 4, wherein, for the adjustment of the height offset (H.2), the dancing roller (1) is supported in a supporting arm (12), wherein the supporting arm is arranged on the frame (11) in a pivoting manner and wherein the pivoting position of the supporting arm (12) relative to the frame (11) is adjustable.

6. The device according to claim 3, wherein a distance (D) in the conveying direction (F) between the dancing roller (1) and the stopping means (2) is adjustable.

7. The device according to claim 5 wherein a distance (D) in the conveying direction (F) between the dancing roller (1) and the stopping means (2) is adjustable and wherein the dancing roller (1) is displaceable along the supporting arm (12).

8. The device according to claim 3, wherein a minimum distance (H.1) between the dancing roller (1) and the conveying surface (3) is adjustable.

9. The device according to claim 8, wherein, for adjusting the minimum distance (H.1), a connection between the frame (11) and the support (5) is adjustable.

10. The device according to claim 1, wherein the conveying surface (3) comprises openings (31.1) and wherein the device further comprises a suction device (32), which is connected with the openings (31.1) upstream of the stopping means (2).

11. The device according to claim 10, wherein a distance (D) in the conveying direction (F) between the dancing roller (1) and the suction device (32) is adjustable.

12. The device according to claim 11, wherein the dancing roller (1) and the stopping means (2) are spring mounted on a support (5) in a manner to be movable in a limited manner and wherein, for adjusting the distance (D) between the dancing roller (1) and the suction device (32), the support (5) is displaceable parallel to the conveying direction (F).

13. The device according to claim 1, wherein, at least in the region of the stopping means (2), the conveying surface (3) is bent around a bending axis oriented essentially parallel to the conveying direction (F) or is correspondingly stepped, and wherein, in the region of the stopping means (2), the device further comprises bending rollers (7) being aligned with lateral areas of the articles (4).

14. The device according to claim 1, wherein the stopping means (2) comprises first and second surface sections (21, 22) facing upstream, wherein the first and second surface sections (21, 22) are essentially plane and extend transverse to the conveying direction (F) and wherein the first surface section (21) is situated further from the conveying surface (3) than the second surface section and forms an angle of 75 to 80 degrees with the conveying surface (3) and the second surface section (22) is situated closer to the conveying surface (3) and forms an angle of 45 to 60 degrees with the conveying surface (3).

15. The device according to claim 1, wherein the stopping means (2) comprises a braking tongue (23) made out of a flexible material, the braking tongue being arranged to face the conveying surface (3).

16. The device according to claim 13, wherein the conveying surface comprises two lateral conveyor belts and a central conveyor belt wherein the two lateral conveyor belts are configured lower with respect to the stopping means than the central conveyor belt.

17. The device according to claim 1, wherein the stopping means (2) is immovable in the conveying direction (F).

* * * * *